US006954960B2

(12) United States Patent
Pichon

(10) Patent No.: US 6,954,960 B2
(45) Date of Patent: Oct. 18, 2005

(54) SELF-PROPELLED RUNNING APPARATUS FOR CLEANING IMMERSED SURFACE COMPRISING DETACHABLE RUNNING MEMBER(S)

(75) Inventor: Philippe Pichon, Villeneuve de Riviere (FR)

(73) Assignee: Zodiac Pool Care Europe (FR)

( * ) Notice: Subject to any disclaimer, the term of this patent is extended or adjusted under 35 U.S.C. 154(b) by 0 days.

(21) Appl. No.: 10/451,184

(22) PCT Filed: Dec. 11, 2001

(86) PCT No.: PCT/FR01/03932

§ 371 (c)(1),
(2), (4) Date: Jun. 20, 2003

(87) PCT Pub. No.: WO02/50387

PCT Pub. Date: Jun. 27, 2002

(65) Prior Publication Data

US 2004/0045104 A1 Mar. 11, 2004

(30) Foreign Application Priority Data

Dec. 21, 2000 (FR) ..... 00 16784

(51) Int. Cl.[7] ..... E04H 4/16
(52) U.S. Cl. ..... 15/1.7; 15/49.1
(58) Field of Search ..... 15/1.7, 49.1, 50.1, 15/50.3, 52.1, 384, 385; 210/169

(56) References Cited

U.S. PATENT DOCUMENTS 3,716,883 A * 2/1973 Monroe ..... 15/1.7
3,950,809 A * 4/1976 Schatzmann ..... 15/1.7
5,245,723 A * 9/1993 Sommer ..... 15/1.7
6,299,699 B1 * 10/2001 Porat et al. ..... 134/6

FOREIGN PATENT DOCUMENTS

EP 0 990 749 4/2000
FR 2 584 442 1/1987

* cited by examiner

*Primary Examiner*—Robert J. Warden, Sr.
*Assistant Examiner*—Shay Balsis
(74) *Attorney, Agent, or Firm*—Dean W. Russell; Kilpatrick Stockton LLP

(57) ABSTRACT

A self-propelled running apparatus for cleaning a surface immersed in a liquid, includes a tranverse running member having two ends through which it is mounted rotatable on a frame about a tranverse axis of rotation, a device for driving in rotation the member and a frame-mounted guide borne by the frame. The guide is adapted to enable, without dismantling relative to the frame the frame-mounted guide and without dismantling the frame itself, at least the displacement of the running member between a working position and a maintenance position.

12 Claims, 4 Drawing Sheets

Figure 1:
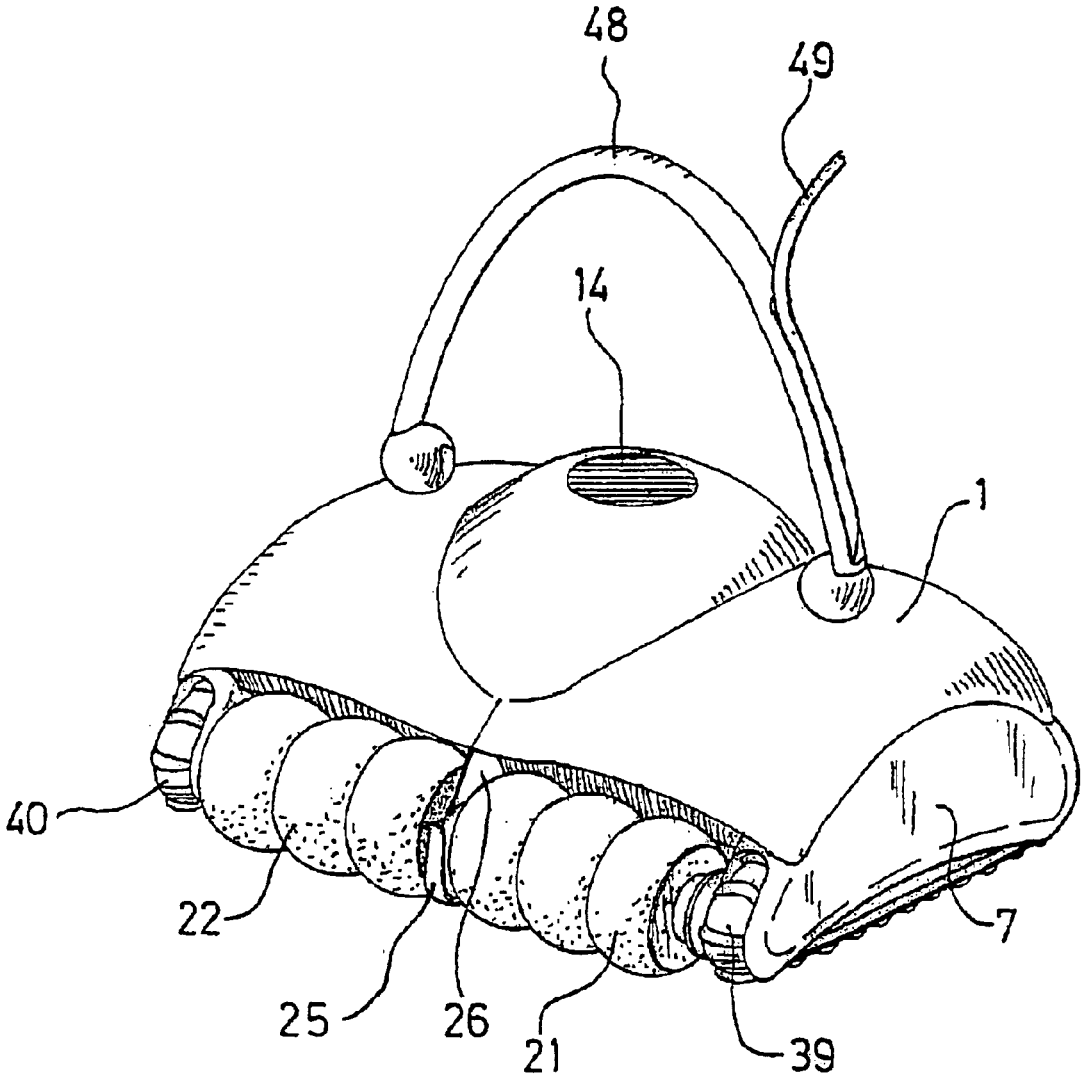

SELF-PROPELLED RUNNING APPARATUS FOR CLEANING IMMERSED SURFACE COMPRISING DETACHABLE RUNNING MEMBER(S)

The invention relates to a rolling apparatus for cleaning a surface submerged in a liquid, such as the bottom, or side walls of a swimming pool, provided with at least one demountable running and/or brushing member. The invention extends to a method for demounting and mounting the running and/or brushing element for the maintenance of the said member.

Some swimming pool-cleaning apparatuses are of the self-propelled rolling type: they comprise running members rotatable around transverse axes of rotation (that is to say perpendicular to the direction of forward movement of the apparatus and at least substantially parallel to the surface on which the latter moves) and driven in rotation around their axis by means of one or more motors (integrated or outside the apparatus, hydraulic or electric, supplied by a watertight electric wire immersed in the swimming pool).

Some swimming pool-cleaning apparatuses are, furthermore, provided with brushing members rotatable around transverse axes, intended to sweep the submersed surface in order to remove any impurities deposited on or even incrusted in the said surface. Left free in terms of rotation, these brushing members have a low efficiency: they rotate as the robot moves without brushing the submerged surface. Therefore, they are generally driven in rotation by at least one motor via a mechanical transmission, and then act as running members. Consequently, hereinbelow the expression "running member" encompasses the brushing members driven in rotation by at least one motor via a mechanical transmission.

The running members of the known self-propelled rolling cleaning apparatuses are in fact driven in rotation by one or more driving shafts, the rotary movement of which is transmitted to the said members by one or more mechanical transmission devices, for example with pinions and/or belts cooperating with at least one of the axial ends of the running member.

Subjected to continual friction with the walls of the swimming pool, the running surfaces of the running members wear out relatively quickly and must therefore be changed regularly. The running members are of two types: they are either of the type having a rotation shaft projecting laterally from the apparatus (lateral wheels or rollers or even crawler tracks) on the side and therefore easily accessible and laterally demountable, or of the type having a rotation shaft guided at its both axial ends (rollers, median wheel(s), . . . ) and driven at least one of the said ends, and therefore fitted guide means (comprising means for driving in rotation) integral with the apparatus frame (both axial ends of the rotation shaft are for example each fixed on a bearing or pinion belonging to a lateral train of pinions for transmitting the driving movement). The brushing members are in most cases of the second type described above. Hereinbelow, such members of the second type are called "double-end-guided" members. The replacement of a running and/or brushing double-end-guided member is time-consuming and complex: since the said member is fitted between guide means, and generally between two lateral walls bearing the said guide means, its demounting requires the demounting of the frame, the various constituent parts of which are assembled by means of screws and bolts, in order to release the said running and/or brushing member. During these maintenance operations, the apparatus is totally immobilised and therefore unavailable for cleaning the swimming pool, thereby putting a great strain on the budgets allocated for maintenance of the said apparatuses.

To overcome these disadvantages, some known apparatuses include running members comprising a support shaft fixed at its both ends to guide (and drive) means, and of at least one flexible peripheral covering in contact with the ground (foam, brush, etc.), which may be separated from the support shaft without demounting the latter. To this end, the covering is in the form of a sheet or strip and/or has, over its entire length, a mounting opening in order to enable mounting on the support shaft by winding or wrapping, then fixing the longitudinal end edges by means of fixing means provided for this purpose and distributed over the length of the arrangement (peripheral adhesive strips, hooks at the longitudinal edges of the inner cylindrical surface of the covering (surface in contact with the support shaft). Some of these coverings, on their inner cylindrical surface, are provided with means for reinforcing the adherence of the covering to the shaft (antislip strips, adhesives, etc.), in order to ensure that said covering is driven in rotation by the shaft. Other coverings are secured to the shaft through their mounting method: fixing under stress, in order to eliminate any clearance between the covering and the shaft.

However, the inventors have nevertheless shown that this solution, which enables the wearing component of a running member, namely the covering(s), to be replaced without demounting the support shaft and therefore the frame, has disadvantages. The mounting of a covering is made difficult through the virtual inaccessibility of the longitudinal edges of the inner cylindrical surface when the covering is folded over and ready to be fixed, in particular in the case of a cylindrical covering having a specific thickness. The mounting and fixing of the covering on the shaft is a long and awkward operation, especially since the devices for fixing the longitudinal edges are numerous (a large number of devices—with hooks for example—distributed over the entire length of the covering is necessary to effectively secure the shaft and the covering). In the case of hooks placed at or close to the inner cylindrical surface of the covering, these hooks are difficult to access. In the case of adhesive strips, the mounting requires dexterity on the part of the user to correctly position the covering and the adhesive strips. In all cases, this fixing is imperfect resulting in a running surface which is not perfectly cylindrical. This peripheral cylindrical rolling surface of the covering, intended to be in contact with the walls of the swimming pool, is in fact ruptured at the mounting opening, which destabilises the apparatus when in movement.

For all these reasons, the object of the invention is to propose a self-propelled rolling apparatus for cleaning a submerged surface, the running members of which are of the double-end-guided type, but are adapted to enable their running surface(s) to be changed without the need to demount any part of the frame or to this end use coverings mounted by wrapping or winding. Therefore, the object of the invention is to provide a self-propelled running cleaning apparatus, the running members of which are provided with tubular coverings or are deprived of a covering, but the maintenance of which, in particular in the event of wear, is simple and quick.

"Tubular covering" is understood to mean a covering having a continuous cylinder-of-revolution outer envelope forming a running surface and an axial hollow core intended to receive a support shaft. In the absence of a longitudinal mounting opening, the tubular covering is mounted on the shaft by introducing the shaft into the central core of the covering and sliding it axially therein. "Running member without a covering" is understood to mean a running member, the support shaft and the running surface(s) of which are formed of the same single component and of an assembly of components forming an integral part.

The object of the invention is also to provide a self-propelled rolling cleaning apparatus for which the replacement of a tubular covering of a running member or the replacement of a running member deprived of a covering is a simple and quick operation which is performed without extended immobilisation of the apparatus.

The object of the invention is also to provide such an apparatus, the cost, weight, bulkiness, performance, reliability and service life of which are equivalent to those of the known apparatuses of the art.

To this end, the invention relates to a self-propelled rolling apparatus for cleaning a surface submerged in a liquid, comprising:

at least one transverse running member, having two axial ends by which it is mounted rotatably on a frame around a transverse axis of rotation, means for rotational guiding of the running member, comprising means for driving said member in rotation via at least one of its axial ends, and of which a part at least, called the frame-mounted guide means, is carried by the frame, wherein the guide means are adapted to allow, without any demounting with respect to the frame of the frame-mounted guide means and without any demounting of the frame itself, at least the displacement of the running member between a position, called the working position, in which the running member cooperates with the guide means in order to be driven in rotation around the transverse axis, and a position, called the maintenance position, adapted to enable at least one component forming a running surface of the running member to be replaced. In the maintenance position, the running member is dissociated from at least a part of the guide means, and displaced with respect to the frame to enable for example a covering, a section or the entire running member to be replaced. In contrast to prior apparatuses, in an apparatus according to the invention, the displacement of the running member in the maintenance position is effected without demounting, with respect to the frame, the frame-mounted guide means acting at the axial ends of the said member, and in particular the frame-mounted drive means.

Advantageously and according to the invention, the guide means are adapted to enable a user to displace the running member manually and without tool between its working position and its maintenance position.

Advantageously and according to the invention, the guide means are adapted so that, in the maintenance position, the running member is totally separable from the frame. The guide means are in this case adapted so that, in the maintenance position, both axial ends of the running member are free, and in particular dissociated from the frame-mounted guide means (including the frame-mounted drive means).

In an advantageous embodiment of the invention, the guide means are adapted for displacement between a position called the anchoring position, in which they hold the running member in the working position, and a position called the release position, in which they allow the displacement of the running member between its working position and its maintenance position. At least a part of the guide means is therefore movable or removable, in order to enable all or part of the running member to be displaced or demounted.

In a particularly advantageous embodiment, and according to the invention:

the running member comprises two sections as an axial extension of each other when said member is in the working position, each section having an axial end, called the coupling end, by which, in the working position, it is connected to the other section, and an opposite axial end, called the guiding end, corresponding to an axial end of the running member, the guide means comprise means, called the intermediate removable holding means, adapted to hold each section in the working position at its coupling end and to release said connecting end, in the maintenance position, in order to allow the displacement of the section.

In a known manner, the drive means comprise for example two transmission elements (bearings or pinions, for example) carried by the frame and situated respectively as an axial extension of each section and forming part of a mechanical transmission device adapted to transmit the rotary driving movement of at least one driving shaft. In one embodiment of the invention, the guiding end of each section is associated with the opposite transmission element by a connection adapted to lock the section and the said transmission element in terms of rotation around the transverse axis, and to allow the section to pivot around at least one axis perpendicular to the transverse axis. This connection is for example a pivoting or homokinetic connection (cardan joint). In the working position, the sections are arranged in an axial extension of each other and are fixed in this position by any intermediate removable fastening means connecting the coupling ends of the two sections, such as a pin if one of the sections has a zone partially covering the other section, or an elastic open sleeve or a collar adapted to cover the connecting ends of the two sections. In the maintenance position, the sections have been subjected to a pivoting around an axis perpendicular to the transverse axis and have their coupling end which is free. This embodiment is particularly adapted to any running member having a tubular covering. When the sections are in the maintenance position, the tubular covering or coverings are easily separated from their support shaft by sliding them towards the free connecting end.

In another advantageous and preferred embodiment, and according to the invention, the sections are coaxial and telescopic, the intermediate removable holding means being adapted to maintain, in an anchoring position, a given spacing between the two sections corresponding to their working position, and enable, in a release position, the sections to slide in each other between their working position and their maintenance position, in which the guiding ends of the two sections are separated from the frame and from the frame-mounted guide means (including the frame-mounted drive means).

In this embodiment, each section comprises for example a main support cylinder, of circular or polygonal cross-section, provided with a tubular covering with a central hollow core having the same cross-section as the main support cylinder. The main support cylinders of the two sections furthermore have identical cross-sections. A first section comprises at its connecting end a secondary cylinder, of short length, which is rigidly fixed to the main support cylinder as an axial extension thereof, and whose cross-section is more compact than the cross-section of the main support cylinder, so that this secondary cylinder may be introduced into the main support cylinder of the second section and slide therein.

The guide means advantageously comprise, besides frame-mounted drive means adapted to drive the guiding end of at least one of the sections, frame-mounted end means for radially guiding the guiding end of each of the sections (aperture made in a lateral wall of the frame receiving the said guiding end for example). The maintenance position of the sections corresponds for example to a maximum penetration depth of the secondary cylinder of the first section in the main support cylinder of the second section. It should be noted that this may be any intermediate position so long as, in this position, the guiding ends of the sections can be dissociated from the frame-mounted end means for radial guidance and from the frame-mounted drive means. The working position corresponds to a relative spacing of the main cylinders of the sections allowing the guiding ends of the said sections to be associated with the frame-mounted end means for radial guidance and with the frame-mounted drive means.

The intermediate removable holding means comprise for example a return spring. In an advantageous variant, the sections have axial-abutment means at their connecting end, the abutment means of the two sections being opposite in the transverse direction, and the intermediate removable holding means are adapted to be inserted, in the anchoring position, between the abutment means of the two sections.

In the case of the latter embodiment mentioned above, the axial-abutment means consist for example, for the first section, of the radial shoulder at the junction of the main and secondary support cylinders, and, for the second section, of the radial end edge of its connecting end, the thickness of the main support cylinder of this second section forming on the said radial end edge a border which abuts against the radial shoulder of the first section when the first section is introduced into the second and slid therein. In another embodiment, the abutment means of each section comprise a collar extending in a radially projecting manner from the section at its connecting end. The above-mentioned radially projecting abutment means present an abutment for any intermediate removable fastening means which is arranged between the abutment means of each of the sections, enabling the said intermediate removable holding means to thus hold the two spaced sections in their working position.

Advantageously and according to the invention, the intermediate removable holding means comprise a spacer which is located perpendicularly to the connecting ends of the sections and mounted on the frame so as to be able to pivot around a transverse axis, and the dimension of which in the transverse direction corresponds to the transverse distance between the abutment means when the sections are in the working position. In its anchoring position, the spacer is swung against the connecting ends of the sections and inserted between the abutment means, with which it cooperates to keep the sections spaced from each other. In its release position, the spacer is moved away from the connecting ends of the sections: it is no longer in contact with the abutment means and therefore allows relative sliding of the sections from their working position to their maintenance position.

Advantageously and according to the invention, the intermediate removable holding means also comprise a guiding half-bearing fixed on the frame perpendicularly to the spacer, said guiding half-bearing and spacer being adapted to guide the coupling ends of the sections radially when the spacer is in the anchoring position, and in particular to provide radial guidance for said coupling ends over their entire periphery. They extend in angular sectors which complement each other around the cylindrical connecting ends, thus forming a bearing for rotational guidance. Advantageously and according to the invention, the guiding half-bearing and the spacer have means for reversibly fixing said spacer on said guiding half-bearing when the spacer is in the anchoring position. The guiding half-bearing has for example a notch into which a corresponding rib situated on the spacer is inserted when the latter is in the anchoring position, in order to hold said spacer in this position.

In an advantageous embodiment of the invention, the two sections have at least substantially equal lengths. In the case of intermediate removable fastening means comprising a spacer and a guiding half-bearing, these parts are then mounted on a transverse wall (upper horizontal or vertical for example) of the frame, in a position at least substantially central with respect to the running member.

In another embodiment of the invention, one of the sections has a length virtually equal to the total length of the running member and bears the entire running surface of the member. The other section has no running surface and is short: it is only used for the mounting and demounting of the running member.

Advantageously and according to the invention, the drive means comprise means for coupling an element for transmitting the movement of at least one driving shaft to the guiding end of at least one of the sections, coupling means, a part of which called the section-mounted coupling means, is integral with the section, and a mating part of which, called the frame-mounted coupling means, is integral with the transmission element and therefore carried by the frame, the section-mounted coupling means and the frame-mounted coupling means being adapted to cooperate by simple relative movement into place.

In a preferred embodiment of the invention, the section-mounted coupling means comprise positive-locking means, in particular of the type with grooves, and the frame-mounted coupling means comprise mating positive-locking means, in particular of the type with ribs, projecting from an output journal of a lateral transmission device, the said journal being located as an axial extension of the section. When the sections are in the working position, the section-mounted positive-locking means and the mating frame-mounted (more precisely journal-mounted) positive-locking means cooperate in order to lock the section and the journal in terms of rotation around the transverse axis. When the sections are in the maintenance position, the section-mounted positive-locking means and the mating journal-mounted positive-locking means are separated.

In an advantageous embodiment, for each running member, each of the two sections is coupled, in the working position, to a transmission element situated opposite its guiding end. Each section is preferably coupled to an output journal of a lateral transmission device by coupling means capable of locking the section and the journal in terms of rotation.

Advantageously and according to the invention, the apparatus comprises two independent motors, each adapted to drive one of the sections of the running member (in the case of a single running member) or all of the sections situated on the same side of the apparatus (in the case of an apparatus including different running members). Such a device enables the running members situated on each side of the apparatus to be operated independently and to modify the path of the apparatus by modifying the direction of rotation of all of the sections situated on the same side of the apparatus.

In a variant, for each running member, a first of the two sections is coupled to a transmission element situated opposite its guiding end, and the second section has a guiding end free in terms of rotation, the connecting ends of the two sections having mating coupling means adapted to enable the second section to be driven by the first. By way of example, these coupling means may be two connecting end-pieces having a square or polygonal cross-section, or a pin for securing the telescopic connecting ends, etc.

Advantageously and according to the invention, the guide means and the running member are made of rigid synthetic materials resistant to the environment in which the apparatus moves about (chlorinated water of a swimming pool . . . ).

The invention extends to a method for maintaining a running member of a self-propelled running apparatus for cleaning a submerged surface according to the invention, wherein the following operations are carried out:

in a step called the demounting step, the running member is displaced from its working position to its maintenance position, then, in a step called the replacement step, all or part of the running member, and in particular at least a component forming a running surface of the running member, is replaced, then, in a step called the remounting step, the running member is displaced from its maintenance position to its working position.

Advantageously and according to the invention, in the case of a running member comprising two telescopic sections, the following operations are carried out:

in the demounting step, the guide means, and in particular the intermediate removable holding means, are moved from their anchoring position to their release position, and the sections are made slid in each other from their working position to their maintenance position in order to separate the guiding ends of the sections from the frame, in the replacement step, optionally, the sections are separated from each other at their connecting end in order to replace all or part of a (the) section(s), and the sections are associated again by their connecting end, in the remounting step, the sections are placed in their maintenance position, the section-mounted coupling means being located opposite to the mating frame-mounted coupling means, the sections are made to slid from their maintenance position to their working position in order to associate the section-mounted coupling means with the frame-mounted coupling means, and the guide means, and in particular the intermediate removable holding means, are actuated from their release position to their anchoring position.

The invention also relates to a running apparatus for cleaning a submerged surface and a method for maintaining the running members of the apparatus, characterised in a combination of some or all of the features mentioned above and below.

Figure 2:
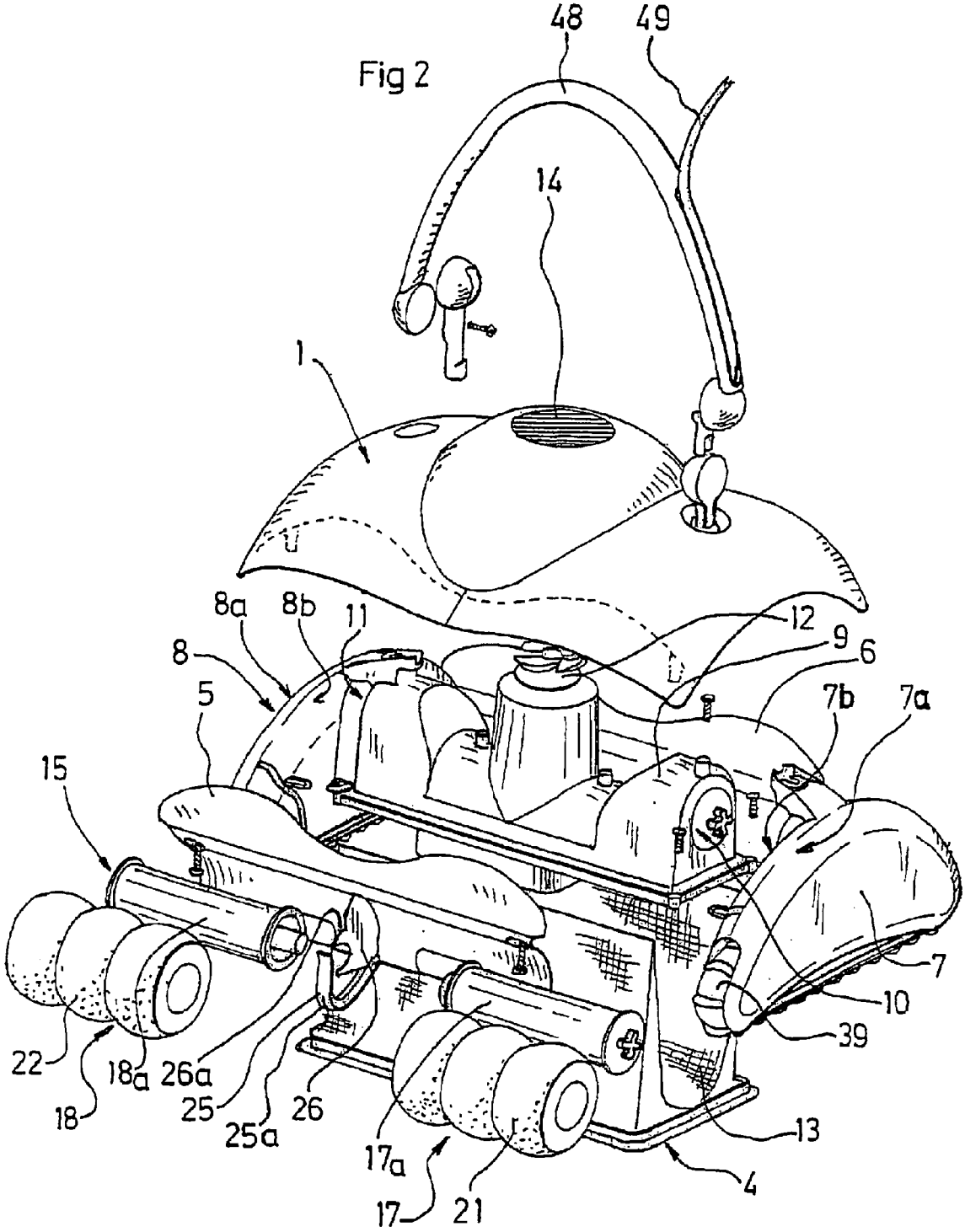
Figure 3:
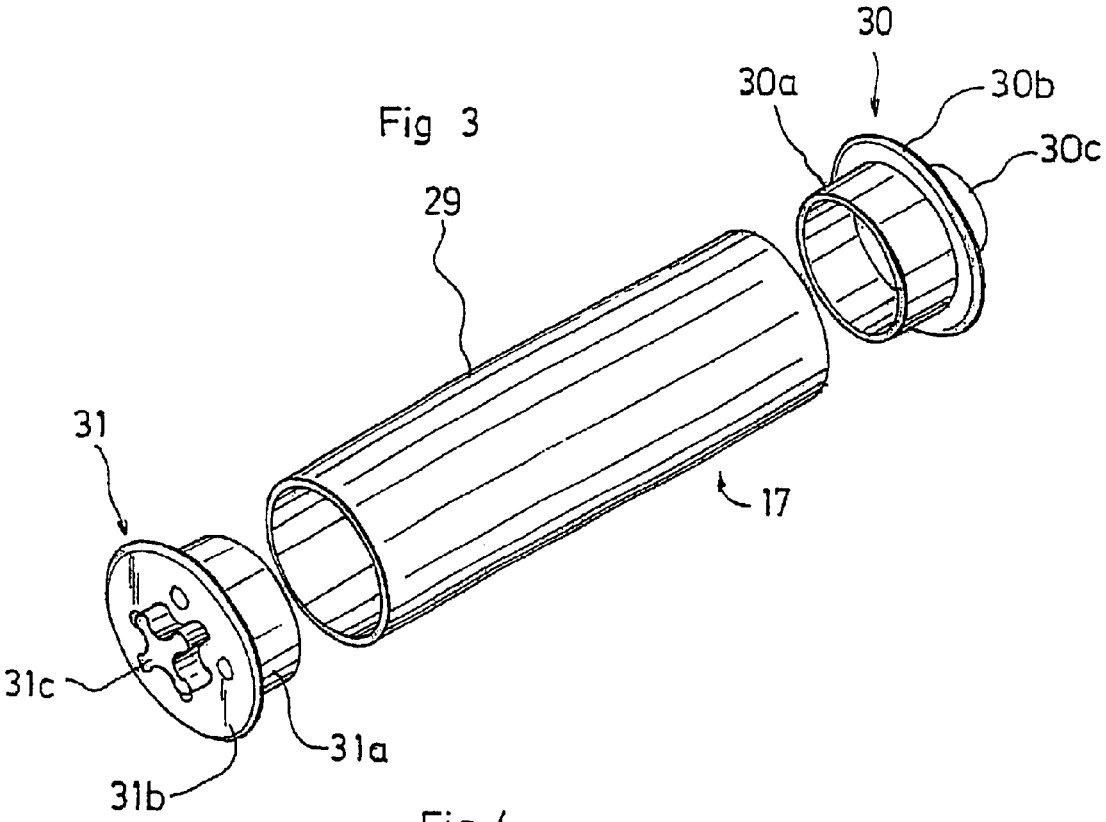
Figure 4:
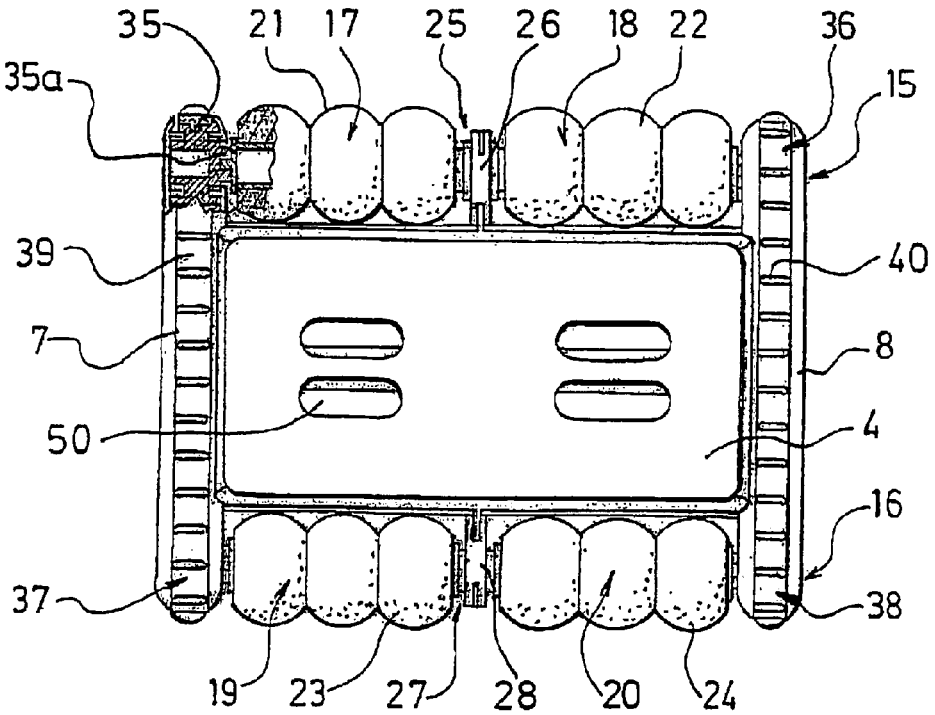
Figure 7:
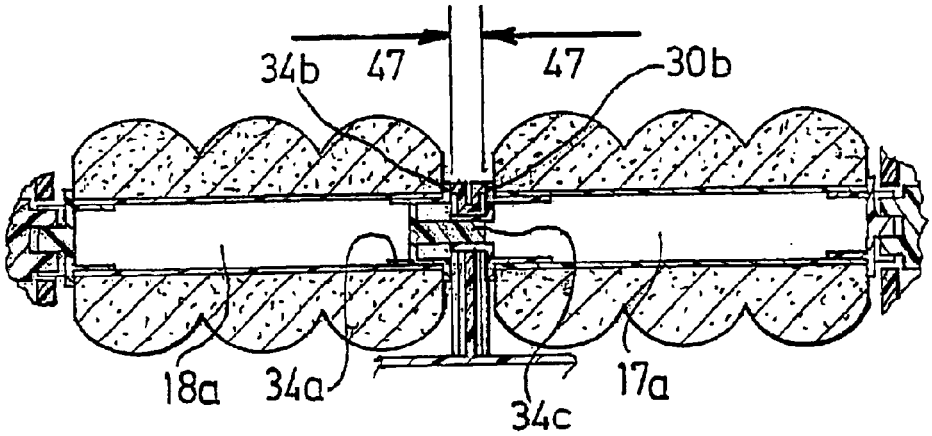
Figure 6:
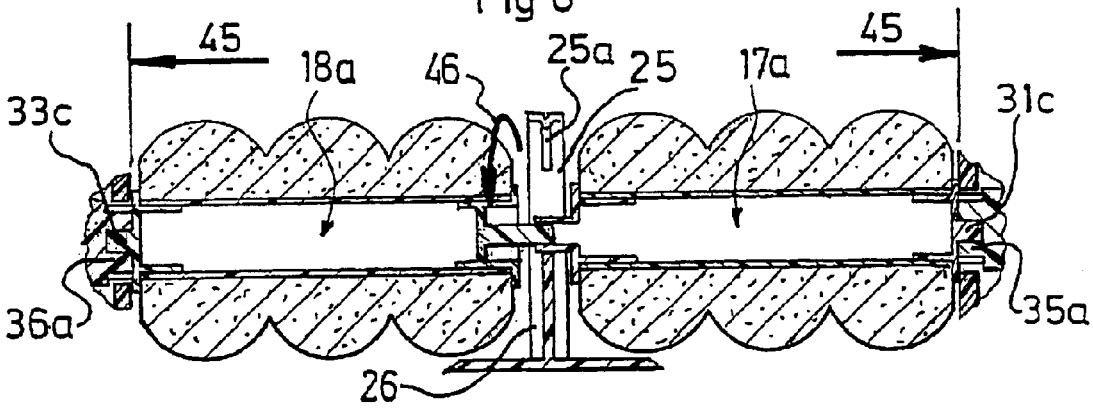
Figure 5:
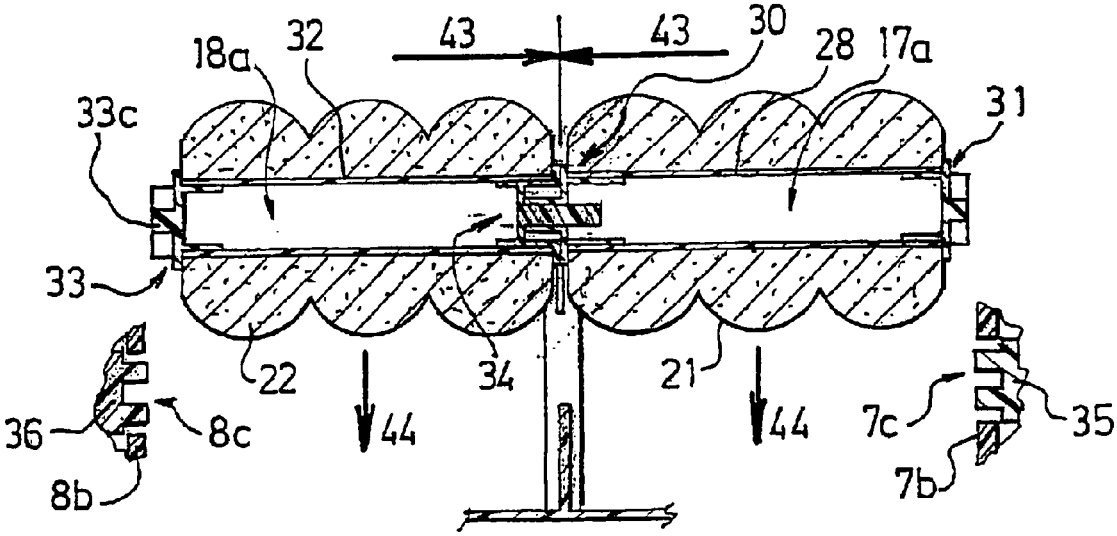

Other objects, features and advantages of the invention will become apparent on reading the following description which refers to the attached figures showing preferred embodiments of the invention given purely as non-limiting examples, and in which:

FIG. 1 is a schematic perspective view of an embodiment of the apparatus according to the invention, FIG. 2 is an exploded schematic perspective view of the embodiment of FIG. 1, FIG. 3 is a perspective view of a section of a running member according to the invention, without its covering, FIG. 4 is a bottom view of an embodiment of the apparatus according to the invention, in which a cutaway part shows a horizontal cross-section of the abutting zone of a section and an output journal of a lateral transmission casing, FIG. 5 shows a horizontal cross-section of a part of an apparatus according to the invention showing a running member in the maintenance position, separated from the guide means and therefore from the frame, FIG. 6 is a horizontal cross-section of a part of an apparatus according to the invention showing a running member in the working position, the guide means being in the release position, FIG. 7 is a horizontal cross-section of a part of an apparatus according to the invention showing a running member in the working position, the guide means being in the anchoring position.

FIGS. 1 and 2 show an embodiment according to the invention of a self-propelled rolling apparatus, called a robot, for cleaning a submerged surface, in particular the wall of a swimming pool, comprising a frame including a top hood 1 with which a handle 48 is associated, a front transverse wall 5 and rear transverse wall 6 which are substantially vertical and connected at their bottom part by means of a bottom wall 4 (visible in FIG. 4), two lateral end walls 7*a* and 8*a*, two lateral intermediate walls 7*b* and 8*b*, the lateral end and intermediate walls 7*a* and 7*b* defining a left-hand lateral transmission casing 7, and the walls 8*a* and 8*b* defining a right-hand lateral transmission casing 8.

It should be noted that the terms "front", "rear", "left-hand" and "right-hand", employed for convenience do not necessarily correspond to the front, rear, left-hand and right-hand portions of the robot defined with respect to its direction of displacement, the robot being symmetrical and being able to move in both directions as will be explained below.

These walls together form a rigid frame defining a receptacle which encloses a motor housing 9 made of rigid synthetic material, incorporating two independent motors, one on each side, one of the motors driving a transverse rotary driving shaft 10, the other motor driving an opposite driving shaft 11, symmetrical with the shaft 10 with respect to a longitudinal median plane of the robot. The shaft 10 and 11, respectively, emerges projecting transversely from the motor casing 9 and is connected to an input journal of the lateral transmission casing 7 and 8, respectively.

It should also be noted that, at its central part, the motor housing 9 encloses a third electric motor driving a pumping propeller 12, creating water suction at the level of water inlet ventils 50 provided in the bottom wall 4 (see FIG. 4). The water thus sucked in passes through a filtering bag 13 carried by the bottom wall 4 and is expelled, cleaned of any impurities, at a top grid 14. The three motors are electrically supplied via the watertight cable 49.

The lateral transmission casing 7 and 8, respectively, encloses a transmission device adapted to transmit the rotary movement of the driving shaft 10 and 11, respectively, to front and rear running members 15 and 16. The transmission casing 7 and 8, respectively, comprises in particular an input journal (not visible) and two output journals 35 and 37, and 36 and 38, respectively, which are shown in particular in FIG. 5 and are all freely rotatable with respect to the walls 7*a* and 7*b* of the casing 7, and 8*a* and 8*b* of the casing 8, respectively, around transverse axes. The input journal of the casing 7 and 8, respectively, is intended to be coupled, that is to say locked in terms of rotation, to the driving shaft 10 and 11, respectively, through an aperture of the wall 7*b* and 8*b*, respectively, and via means described below, and the output journals 35 and 37, and 36 and 38, respectively, are intended to be coupled to the left-hand sections 17 and 19, and right-hand sections 18 and 20, respectively, of the running members 15 and 16 through the same wall 7*b* and 8*b*, respectively. The input journal is driven in rotation by the driving shaft 10 and 11, respectively, and its rotary movement is transmitted simultaneously to the two output journals 35 and 37, and 36 and 38, respectively, via a train of pinions (not shown) which is accommodated in the casing 7 and 8, respectively. The input and output journals of the casing 7 and 8, respectively, are furthermore connected to one another by a crawler track 39 and 40, respectively.

Since the driving shafts 10 and 11 are each controlled by a reversible independent motor, the left-hand sections 17 and 19 being able to rotate in a direction opposite to the direction of rotation of the right-hand sections 18 and 20, thereby enabling the pivoting of the robot in situ around a vertical axis passing through its transverse and longitudinal median planes. By imposing the same direction and the same rotational speed on the driving shafts 10 and 11, the robot moves forwards (or backwards) along a straight line. By imposing the same direction of rotation and different rotational speeds on the driving shafts 10 and 11, the robot may be assigned a complex curved path. The final path may be programmed according to a predefined or random pattern.

The left-hand section 17 and right-hand section 18 of the running member 15 comprise respectively support shafts 17*a* and 18*a* bearing coverings 21 and 22. The left-hand section 19 and right-hand section 20 of the running member 16 comprise respectively the support shafts 19*a* and 20*a* and the coverings 23 and 24 (visible in FIG. 4). The four coverings are identical and produced from synthetic foam or formed of brushes. Being in contact with the surfaces to be cleaned, they are subjected to continual friction which is responsible for their relatively rapid wear, and require regular replacement. The left-hand section 17 and right-hand section 18, and the left-hand section 19 and right-hand section 20, respectively, are joined to each other by their respective connecting end 30 and 34 (FIG. 5), and held in the working position with the aid of intermediate removable holding means 25 and 26, and 27 and 28, respectively (FIG. 4) as will be explained below.

FIG. 3 shows in detail an embodiment of one of the left-hand sections 17 or 19. It is composed of three parts: a hollow cylindrical central body 29, at the axial ends of which are fitted two end-pieces 30 and 31. The end-piece 30 constitutes the connecting end of the section 17. It comprises a cylindrical part 30*a* having a diameter slightly smaller than that of the central body 29 in order to allow said part 30*a* to be fitted into the said body 29, an abutment collar 30*b*, against which the intermediate holding means, and in particular the hook 25, are intended to abut and acting furthermore as a guide for the covering, and a second cylindrical part 30*c* with an even smaller diameter intended to receive the connecting end of the other section. The end-piece 31 constitutes the guiding end of the section 17. It includes a cylindrical part 31*a* having a diameter slightly smaller than that of the central body 29 to allow the said part 31*a* to be fitted into the said body 29, an abutment collar 31*b* intended to abut against the oppositely located end of the central body 29 and acting furthermore as a guide for the covering, and a positive-locking cross 31*c* constituting the section-mounted coupling means of the said section 17 and intended to be associated with four positive-locking pins 35*a* projecting from the journal 35 opposite, constituting the mating frame-mounted (or more precisely journal-mounted) coupling means. The association of the section-mounted coupling means 31*c* and journal-mounted coupling means 35*a* is effected by simple relative movement into place and is illustrated in FIG. 4.

The end-pieces 30 and 31 are rigidly fixed on the central body 29 at the level of their cylindrical part 30*a* and 31*a*, by blocking connections (pins, screws . . . , not shown) and/or by friction connections (crimping . . . ), so that the three parts of the section are locked, in particular in terms of rotation.

The right-hand section 18 or 20 likewise consists of three parts 32, 33 and 34 visible in FIGS. 5, 6 and 7. The body 32 and the guiding end-piece 33, intended to be coupled to the journal 36, are identical to those of the section 17. The connecting end-piece 34 likewise comprises three coaxial overall cylindrical parts, namely a cylinder 34*a* having a diameter slightly smaller than that of the central body 32 in order to allow the said cylinder 34*a* to be fitted into the said body 32, an abutment collar 34*b* in an extension of the cylinder 34*a*, and a cylinder 34*c* intended to fit into the cylindrical part 30*c* of the end-piece 30 of the section 17 and axially projecting from the abutment collar 34*b*. The three parts 34*a*, 34*b* and 34*c* of the right-hand section 18 are rigidly fixed to one another identically to those of the left-hand section 17.

FIGS. 5, 6 and 7 illustrate the method for mounting the running member 15 on the walls 7*b* and 8*b* of the housing, in correspondence with the journals 35 and 36. As illustrated in FIG. 5, the left-hand section 17 and right-hand section 18 are pushed into each other in accordance with the arrows 43 until the collars 30*b* and 34*b* of the connecting ends of the said sections are in abutment. The relative position of the sections in this figure is called the maintenance position. The assembly thus formed is placed between the walls 7*b* and 8*b* (arrows 44) so that the guiding end-piece 31 and 33, respectively, faces an aperture 7*c* and 8*c*, respectively, made in the wall 7*b* and 8*b*, respectively, and constituting the frame-mounted end means for radially guiding the section. It is through this same aperture that the section-mounted coupling means 31*c* and 33*c*, respectively, are furthermore associated with the mating journal-mounted coupling means 35*a* and 36*a*, respectively, (projecting from the journal 35 and 36, respectively). To this end, the left-hand section 17 and right-hand section 18 are subjected, if necessary, to a slight rotation around their axis in order to position the positive-locking crosses 31*c* and 33*c* of the sections 17 and 18 in correspondence with the positive-locking pins 35*a* and 36*a* of the journals 35 and 36.

The two sections are then moved apart in accordance with the arrows 45, as illustrated in FIG. 6, so as to associate the positive-locking crosses 31*c* and 33*c* with the positive-locking pins 35*a* and 36*a*, and the spacer 25 is swung towards the guiding half-bearing 26 in accordance with the arrow 46. The intermediate removable holding device 25, 26 is locked by simply pressing the free end of the spacer onto the guiding half-bearing, the latter having a notch 26*a* (see FIG. 2) adapted to receive a rib 25*a* present on the spacer 25. The collars 30*b* and 34*b* are then in abutment against the spacer 26 (FIG. 7, arrows 47), thereby making it possible to hold the sections in the working position.

The demounting of the running member 15 is effected by repeating the above operations in reverse order. It takes only a few seconds, and enables the coverings 21 and 22 to be replaced quickly: when the running member is separated from the walls 7*b* and 8*b* and the journals 35 and 36 (FIG. 5), the tubular covering 21 and 22, respectively, is slid axially until it is completely separated from the support shaft 17*a* and 18*a*, respectively. This is made possible by the choice of materials from which the covering is manufactured: the used flexible and slightly extensible foam allows an enlargement of the diameter of the central hollow core of the covering by simple radial traction exerted on said covering by the maintenance person, which enlargement enables the covering to be slid over the abutment collar 31*b* and 33*b*, respectively, or 30*b* and 34*b*, respectively. If this is not the case, the end-piece 31 and 33, respectively, is demounted by unscrewing for example the fixing screws holding it on the section 17 and 18, respectively. In the case of a running member without a covering, once the said member is dissociated from the frame and its various guide means, it is easy to change one or both sections in their entirety and to put them back in the working position as explained above.

The maintenance method according to the invention enables all or part of a running member to be replaced simply and quickly, without demounting the frame-mounted drive means (lateral transmission casings 7 and 8, journals 35, 36, 37 and 38, etc.) or any part of the apparatus frame.

A man in the art understands that the invention may have numerous variants with respect to the embodiments described above and shown in the figures, given as non-limiting examples.

In particular, in a first variant, each section comprises for example a main support cylinder, of circular or polygonal cross-section, provided with a tubular covering having a central hollow core having the same cross-section as the main support cylinder. The main support cylinders of the two sections furthermore have identical cross-sections. A first section comprises at its connecting end a secondary cylinder, of short length, which is rigidly fixed to the main support cylinder as an axial extension thereof, and whose cross-section is more compact than the cross-section of the main support cylinder, so that this secondary cylinder can be introduced into the main support cylinder of the second section and slide therein.

In this variant, the axial abutment means consist, for the first section, of the radial shoulder occurring at the junction of the main and secondary support cylinders, and, for the second section, of the radial end edge of its connecting end, the thickness of the main support cylinder of this second section forming on the said radial end edge a border abutting against the radial shoulder of the first section when the first section is introduced into the second and slid therein. In a manner identical to the example described with reference to the attached figures, in this variant, the intermediate removable holding means comprise a spacer and a guiding half-bearing, these latter being inserted between the radial shoulder of the first section and the radial end edge of the second section in the anchoring position.

It should be noted that the sections are not necessarily telescopic. Thus, in a second variant according to the invention, the sections are, in the working position, an axial extension of each other and juxtaposed at their coupling end and fixed in this position by any intermediate removable holding means connecting the connecting ends of the two sections, such as a pin if one of the sections has a zone partially covering the other section, or an elastic open sleeve or a collar adapted to cover the connecting ends of the two sections. The guiding end of each section is associated with an opposite transmission element (pinion, bearing . . . ) by a connection adapted to lock the section and the said transmission element in terms of rotation about the transverse axis, and to allow the section to pivot around at least one axis perpendicular to the transverse axis. This connection is for example a pivoting or homokinetic connection (cardan joint). To displace the sections from their working position to their maintenance position, the connecting ends initially held by the intermediate removable holding means are separated, and said sections are subjected to a pivoting around an axis perpendicular to the transverse axis. The connecting end of each section is then free. This embodiment is particularly adapted to any running member having a tubular covering. When the sections are in the maintenance position, the tubular covering or coverings are easily separated from their support shaft by being slided them towards the free connecting end.

What is claimed is:

1. A self-propelled running apparatus for cleaning a surface submerged in a liquid, comprising:

at least one transverse running member, having two axial ends by which it is mounted rotatably on a frame around a transverse axis of rotation, and means for rotationally guiding the running member, comprising means for driving said member in rotation via at least one of its axial ends, and of which a part at least, called the frame-mounted guide means, is carried by the frame, wherein the guide means are adapted to allow, without any demounting with respect to the frame of the frame-mounted guide means and without any demounting of the frame itself, at least the displacement of the running member between a position, called the working position, in which the running member cooperates with the guide means so as to be driven in rotation around the transverse axis, and a position, called the maintenance position, adapted to enable at least one component forming a running surface of the running member to be replaced, wherein the running member comprises two sections as an axial extension of each other when the said member is in the working position, each section having an axial end, calling the coupling end, by which, in the working position, it is connected to the other section, and an opposite axial end, called the guiding end, corresponding to an axial end of the running member, wherein the guide means comprise means, called the intermediate removable holding means, adapted to hold each section in the working position at its coupling end and to release said coupling end, in the maintenance position, in order to allow the displacement of the section, and wherein the sections are coaxial and telescopic, the intermediate removable holding means being adapted to maintain, in an anchoring position, a given spacing between the two sections corresponding to their working position, and enable, in a release position, the sections to slide in each other between their working position and their maintenance position, in which the guiding ends of the two sections are separated from the frame and from the frame-mounted guide means.

2. An apparatus as claimed in claim 1, wherein the sections have axial-abutment means at their coupling end, the abutment means of the two sections being opposite in the transverse direction, and wherein the intermediate removable holding means are adapted to be inserted, in the anchoring position, between the abutment means of the two sections.

3. An apparatus as claimed in claim 2, wherein the intermediate removable holding means comprise a spacer which is located perpendicularly to the coupling ends of the sections and mounted on the frame enabling them to pivot around a transverse axis, and the dimension of which in the transverse direction corresponds to the transverse distance between the abutment means when the sections are in the working position.

4. An apparatus as claimed in claim 3, wherein the intermediate removable holding means comprise a guiding half-bearing fixed on the frame perpendicularly to the spacer, the said guiding half-bearing and spacer being adapted to guide the connecting ends of the sections radially when the spacer is in the anchoring position.

5. An apparatus as claimed in claim 4, wherein the guiding half-bearing and the spacer are provided with means for reversibly fixing the said spacer to the said guiding half-bearing when the spacer is in the anchoring position.

6. An apparatus as claimed in claim 1, wherein the two sections have at least substantially equal lengths.

7. An apparatus as claimed in claim 1, wherein the drive means comprise means for coupling an element for transmitting the movement of a driving shaft to the guiding end of at least one of the sections, a part of which, called the section-mounted coupling means, is integral with the section, and a mating part of which, called the frame-mounted coupling means, is carried by the frame, the section-mounted coupling means and the frame-mounted coupling means being adapted to cooperate by simple relative movement into place.

8. An apparatus as claimed in claim 7, wherein the section-mounted coupling means comprise positive-locking means, with grooves, and wherein the frame-mounted coupling means comprise mating positive-locking means with ribs, projecting from an output journal of a lateral transmission device, the said journal being situated as an axial extension of the section.

9. An apparatus as claimed in claim 7, wherein, for each running member, each of the two sections is coupled to a transmission element situated adjacent its guiding end.

10. An apparatus as claimed in claim 9, which comprises two independent motors, each adapted to drive one of the sections of the running member or all of the sections located on the same side of the apparatus belonging to different running members.

11. An apparatus as claimed in claim 7, wherein a first of the two sections is coupled to a transmission element situated adjacent its guiding end, and wherein the second section has a guiding end free in terms of rotation, the connecting ends of the two sections having mating coupling means adapted to enable the second section to be driven by the first.

12. An apparatus as claimed in claim 1, wherein the guide means and each running member are made of rigid synthetic materials.

* * * * *